United States Patent [19]

Prus et al.

[11] Patent Number: 4,962,724

[45] Date of Patent: Oct. 16, 1990

[54] INSTALLATION FOR SPRAYING COATING PRODUCT, NOTABLY WATER-SOLUBLE PAINT

[75] Inventors: Eric Prus; Adrien Lacchia, both of Grenoble, France

[73] Assignee: Sames S.A., Meylan, France

[21] Appl. No.: 393,871

[22] Filed: Aug. 14, 1989

Related U.S. Application Data

[63] Continuation of Ser. No. 232,098, Aug. 15, 1980, abandoned.

[30] Foreign Application Priority Data

| | | | |
|---|---|---|---|
| Aug. 14, 1987 | [FR] | France | 8711577 |
| Oct. 7, 1987 | [FR] | France | 8713855 |
| Jul. 1, 1988 | [FR] | France | 8808944 |

[51] Int. Cl.[5] ..... B05B 5/16; B05B 5/053

[52] U.S. Cl. ..... 118/688; 118/621; 118/629; 118/302; 239/68; 239/690; 239/708

[58] Field of Search ..... 118/313, 314, 315, 326, 118/621, 629, 630, 631, 632, 633, 302, 688, 698, 692, 684, 698, 712, 713, 302; 239/3, 63, 68, 69, 690, 708

[56] References Cited

U.S. PATENT DOCUMENTS

| | | | |
|---|---|---|---|
| Re. 32,151 | 5/1986 | Scharpfenberger | 118/688 |
| 3,145,930 | 8/1964 | Herklotz et al. | 118/302 |
| 3,166,438 | 1/1965 | Wampler et al. | 118/302 |
| 3,348,774 | 10/1967 | Wiggins | 118/302 |
| 3,385,522 | 5/1968 | Kock | 118/302 |
| 3,450,092 | 6/1969 | Kock | 118/302 |
| 3,450,892 | 6/1969 | Kock | 118/302 |
| 3,477,870 | 11/1969 | Boretti et al. | 118/302 |
| 3,674,207 | 7/1972 | Carbonetti | 239/69 |
| 3,933,285 | 1/1976 | Wiggins | 239/3 |
| 3,971,337 | 7/1976 | Hastings | 118/629 |
| 4,017,029 | 4/1977 | Walberg | 118/629 |
| 4,337,282 | 3/1983 | Springer | 427/421 |
| 4,348,425 | 9/1982 | Scharfenberger | 427/8 |
| 4,375,865 | 3/1984 | Springer | 118/302 |
| 4,562,088 | 12/1985 | Navarro | 118/692 |
| 4,592,305 | 6/1986 | Scharfenberger | 118/302 |
| 4,614,300 | 9/1986 | Falcoff | 239/69 |
| 4,660,771 | 4/1987 | Chabert et al. | 239/69 |
| 4,676,189 | 6/1987 | Takeuchi et al. | 118/326 |
| 4,792,092 | 12/1988 | Elberson et al. | 239/3 |
| 4,881,563 | 11/1989 | Christian | 118/302 |

FOREIGN PATENT DOCUMENTS

| | | | |
|---|---|---|---|
| 0178746 | 4/1986 | European Pat. Off. | 118/631 |
| 2819302 | 11/1979 | Fed. Rep. of Germany | 118/698 |
| 2924264 | 12/1980 | Fed. Rep. of Germany | 118/692 |
| 2561947 | 10/1985 | France | 118/693 |
| 2572662 | 5/1986 | France . | |
| 2166982 | 5/1986 | United Kingdom . | |

*Primary Examiner*—Willard Hoag

*Attorney, Agent, or Firm*—Sandler, Greenblum & Bernstein

[57] ABSTRACT

An installation for spraying coating product, such as water-soluble or metallic paint to be sprayed onto automobile bodies, comprises a coating product change unit on a downstream side of which is at least one distribution pipe. This feeds at least one sprayer for the coating product. An intermediate storage tank for the coating product formed in the distribution pipe(s) consists of a section of the pipe itself. An arrangement is provided for feeding rinsing product into the distribution pipe(s) and, by virtue of a selective connection device, the coating product is propelled by the rinsing product during spraying.

30 Claims, 6 Drawing Sheets

INSTALLATION FOR SPRAYING COATING PRODUCT, NOTABLY WATER-SOLUBLE PAINT

This is a continuation of application Ser. No. 07/232,098 filed Aug. 15, 1988, now abandoned.

BACKGROUND OF THE INVENTION

1. Field of the invention

The invention concerns an installation for spraying coating product, notably an electrically conductive coating product such as a water-soluble or metallic paint applied electrostatically; it is more particularly concerned with a new arrangement for changing such products rapidly. The invention finds a particularly beneficial field of application in areas where the objects to be coated succeed each other along a common spraying location and where any two consecutive objects have generally to be covered with coating product of different colors. Operating constraints of this kind requiring extremely rapid color change cycles are encountered in the automobile industry in particular, for painting bodywork members. The invention is more particularly directed to solving the additional problems which arise in this context from electrostatic application of water-soluble and some metallic paints having a relatively high electrical conductivity.

2. Description of the prior art

A paint spraying installation in a production unit as large as an automobile manufacturing plant, for example, generally comprises several closed loop paint circuits which are very long (these circuits may cross an entire section of the plant) and which establish the connection between large paint storage tanks and the various spraying booths. It is therefore necessary to provide a circuit of this kind for each color and another circuit of the same kind for the solvent or cleaning product. For obvious safety reasons these circuits are electrically grounded.

In a paint spraying booth supplied in this way the objects to be painted, which are automobile bodies in the example under consideration here, are carried by conveyor means which pass through the booth in which are electrostatic spraying means operative within a specific "activity area" within the booth.

These spraying means may be "bowls" rotating at high speed or pneumatic or hydrostatic sprayers. A routine problem to be solved in this type of installation is that of changing color between two consecutive objects. In the automobile industry in particular there is no question of painting bodies in series the same color. To the contrary, the usual situation is that the color has to be changed virtually every body. This implies the ability to carry out extremely rapid spraying means rinsing and drying cycles. To give an example, a color change may take place about every minute and the time allowed for carrying out all the operations necessary for changing color may be in the order of 10 seconds.

In known conventional installations all the coating product circuits, a compressed air circuit and a cleaning product circuit are connected via isolating valves to a manifold having a common outlet branch connected to the sprayer. This arrangement will be referred to hereinafter as a "coating product change unit" or, more simply, a "color change unit". Conventionally, to change color the valve on the circuit of the coating product in use must be closed a particular (computed) time before the end of the current spraying phase and then the compressed air valve opened to propel the remaining product towards the sprayer. A cleaning cycle is then carried out comprising a succession of injections of cleaning product and compressed air until the pipes are clean and dry. Finally, the valve on another coating product circuit is opened to fill the manifold and the pipes until a little of the new color coating product exits the sprayer. A new paint spraying phase may then begin.

If the installation contains only a small number of different color coating products, say three or four, the manifold may be located relatively near the sprayer. However, this solution is no longer practical if there are too many different coating products (there may be 20 or even more), and the color change unit must then be located remotely of the sprayer or sprayers. If the objects to be coated are large, as is the case with automobile bodies, the spraying means move over great distances parallel to the longest dimension of the objects, covering five or six meters, for example, especially in the case of robots. In this case the color change unit is very remote from the sprayer or sprayers, which considerably increases the volume of pipes to be cleaned and therefore the duration of the color change sequences. Because of this the quantities of coating product and cleaning product wasted on each color change cycle are large, in the order of several hundred cubic centimeters.

In an electrostatic installation all these color change related problems are further accentuated if coating products which have a low electrical resistivity, as do water-based paints, for example, are to be used without losing the advantages of electrostatic spraying. In this case the sprayer is often raised to a high-tension voltage and it is necessary to avoid short-circuiting between the sprayer and the coating product circuits which are electrically grounded. To counter the specific problem of changing color with low resistivity coating products, French patent No 2 572 662 (and the corresponding United Kingdom patent application No 2 166 982A published 5-21-86) proposes to fill an intermediate storage tank with just the sufficient quantity of paint for each application. The arrangement is such that this intermediate storage tank is grounded while it is being filled and at the high-tension voltage when it is feeding the sprayer or sprayers. The same intermediate storage tank is used for all colors, with the result that each color change makes it necessary to clean the storage tank and also all the pipes connected to it.

Also, it is relatively difficult in this type of installation to adjust the quantity of coating product to be fed into the intermediate storage tank. This quantity must be sufficient for the entire object to be painted. However, any excess is lost on rinsing which leads to a reduction in the overall efficiency of deposition and may result in the loss of all or part of the benefits obtained from electrostatic application. The invention makes it possible to overcome these problems.

SUMMARY OF THE INVENTION

The invention consists in an installation for spraying coating product, comprising a coating product change unit, rinsing product feed means, at least one distribution pipe on a downstream side of said coating product change unit, at least one sprayer for said coating product fed by said at least one distribution pipe, an intermediate storage tank in said at least one distribution pipe constituted by a section of said pipe, and selective connection means whereby during spraying said coating product is propelled by said rinsing product.

The fact that the intermediate storage tank has been converted to a pipe has numerous advantages.

Because of its new shape, the intermediate storage tank is much easier to clean, requiring less product and therefore enabling time to be saved.

By "propelling" the coating product with the solvent or rinsing product over the entire length of the intermediate storage tank cleaning of all the upstream pipes and the intermediate storage tank itself starts during the coating product spraying phase.

By judiciously placing one or more flowrate sensors in the installation, the quantity of product injected on each cycle and the spraying of this product can be very accurately controlled.

The installation preferably includes a distribution pipe adapted to be connected to a high-tension voltage supply, at least one electrically insulative pipe connected to said distribution pipe and means for blowing air into said at least one electrically insulative pipe during at least part of the time for which said distribution pipe is connected to said high-tension voltage supply, to improve the drying and to avoid any short-circuit phenomena attributable in particular to possible ionization of moist air in the pipes.

At least part of the aforementioned at least one electrically insulative pipe has a serpentine configuration, preferably oriented so that its axis is substantially horizontal.

This prevents the formation of a continuous film of liquid inside the pipe. The electrical "path" is therefore interrupted on each turn and the drops of liquid are "trapped", pending complete evaporation, in the substantially horizontal parts of the serpentine configuration.

The coating product change unit is electrically grounded, for the reasons explained above. If the installation is adapted for electrostatic application of said coating product, said distribution pipe is sequentially connected to a high-tension voltage applied to the electrostatic sprayer. In this case the selective connection means are disposed between the intermediate storage tank and the coating product change unit and rinsing product feed means electrically insulated from ground, whereby during the electrostatic spraying phase the coating product can be propelled by the rinsing product from these electrically insulated feed means.

The usual rinsing product for water-soluble paints is water containing some alcohol; it is then necessary to provide a quantity of rinsing product in a storage tank electrically insulated from ground, so that the sprayer or sprayers is (or are) not grounded by the paint and the rinsing product. The presence of a storage tank periodically raised to the high-tension voltage and which may not be in the cabinets enclosing the high-tension components of the sprayer may be a disadvantage in some cases. For this reason one embodiment of the invention proposes a coating product spraying installation basically as defined hereinabove, for electrostatic application of said products, wherein said at least one sprayer includes at least one electrostatic sprayer adapted to be connected to a high-tension voltage supply, said coating product change unit is electrically grounded, said at least one distribution pipe is adapted to be connected at least while spraying is in progress to said high-tension voltage supply and said rinsing product has a high electrical resistivity, the installation further comprising an electrically grounded flowrate sensor on an upstream side of said at least one distribution pipe and a guard channel between said sensor and said intermediate storage tank the length and cross-section of which are such that when filled with said rinsing product it diverts to said grounded flowrate sensor only a minimal part of the electrical current consumed by said at least one electrostatic sprayer.

It will be understood that the guard channel will comprise a tube of as small a cross-section as possible given the permissible head losses, into which the rinsing liquid will be injected after the necessary quantity of coating product. Given the small cross-section of the guard channel and the flow speed of the rinsing product, most of the rinsing effect will be obtained in the front part of the column of rinsing liquid and there will be minimum diffusion of coating product residues towards the upstream end of this column; thus when the flowrate sensor indicates that the advancing paint front has reached the sprayer an electrically insulative column of rinsing product will have been established in the guard channel and will limit shunting of electrical current from the sprayer at the high-tension voltage to an acceptable value, in spite of the significant conductivity of the coating product in the intermediate storage tank.

It will be noted that with this arrangement the selective connection means may be combined with the set of valves of the coating product change unit, all the circuits on the upstream side of the electrically grounded flowrate sensor being protected against current shunted from the sprayer or sprayers.

The coating product and the electrically insulative rinsing liquid can be propelled by a volumetric pump, preferably a gear pump, immediately adjacent the flowrate sensor on its upstream side and in this instance electrically grounded. Alternatively, propulsion may be secured by pressurizing the coating and rinsing product feeds, in conjunction with a rinsable pressure regulator between the intermediate storage tank and the sprayer or sprayers.

The installation preferably further comprises a purge circuit branching from said at least one distribution circuit immediately adjacent said at least one sprayer on its upstream side and including a valve near said at least one distribution pipe, an electrically grounded purge manifold and an electrically insulative pipe discharging into said manifold.

A preferred embodiment further comprises an electrically insulated connection circuit between said guard channel and said intermediate storage tank, a rinsing circuit, a purge manifold and electrically insulative pipes between said connection circuit and said rinsing circuit and said purge manifold, said connection circuit being adapted to connect said intermediate storage tank selectively to said guard channel and said rinsing circuit.

With this arrangement it is possible to rinse and blow out the guard channel between filling the intermediate storage tank and delivering the coating product to the sprayer and also to begin feeding the coating product (in the guard channel) before the end of rinsing and blowing out the intermediate storage tank. Rinsing the guard channel immediately after filling the intermediate storage tank ensures in particular that the guard channel will not provide an electrical leakage path from the high-tension voltage supply to ground as a result of the deposition of metallic or water-soluble paint on its inside wall.

It is possible to duplicate the distribution pipe and the guard channel so that two distribution pipes can be connected alternately to the coating product change unit via the flowrate sensor and to a rinsing circuit, also electrically grounded.

In this way one pipe can be rinsed and dried while the other is spraying.

The invention will be better understood and other advantages of the invention will emerge more clearly from the following description of a number of installations in accordance with the invention given by way of non-limiting example only and with reference to the appended drawings.

DESCRIPTION OF THE PREFERRED EMBODIMENTS

Figure 1:
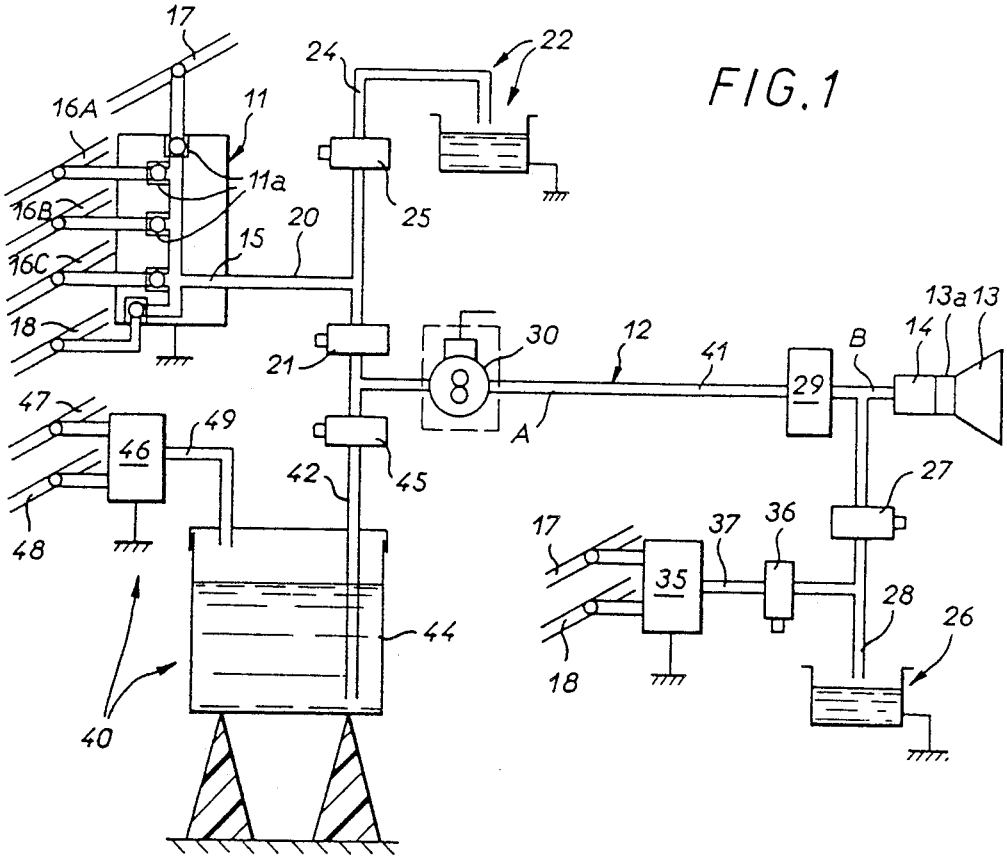
FIG. 1 is a schematic diagram of a first embodiment of a paint spraying installation in accordance with the invention.

Referring to FIG. 1 in particular, the paint spraying installation shown comprises a color change unit 11 and a distribution pipe 12 extending between said color change unit 11 and at least one electrostatic sprayer 13 fitted with a needle valve 14 controlling the flow of paint. This sprayer, connected to an adjustable and/or interruptible high-tension voltage supply 13*a* is placed in a spraying booth (not shown) through which pass objects to be painted different colors. The distribution pipe 12 is therefore fed by the color change unit 11 which selects the required color. The distribution pipe 12 supplies a certain quantity of paint of the selected color, predetermined according to the size of the object to be painted, to the sprayer 13. During the paint spraying phase, the sprayer is at a high-tension voltage; the conventional high-tension voltage supply is not shown. As previously mentioned, the paint used is electrically conductive (water-soluble or metallic paint) and the distribution pipe 12 is raised to the high-tension voltage at the same time as the sprayer. In the known way the color change unit 11 comprises a set of selector solenoid valves 11A whereby its outlet manifold 15 may be placed in communication with one of the following circuits:

one of the paint circuits 16A, 16B, 16C, each of which circuits corresponds to a particular color, or a rinsing product circuit 17 (for a water-soluble paint this is water possibly containing alcohol); or a compressed air circuit 18.

The outlet from the manifold 15 is connected to the distribution pipe 12 by electrically insulative means comprising an electrically insulative material pipe, referred to hereinafter as the first electrically insulative pipe 20, a valve 21 and purge means 22. The downstream end of the electrically insulative pipe 20 is connected to the distribution pipe 12 through the valve 21 and to the purge means 22 through a valve 25, via an electrically insulative pipe portion 24. The installation further comprises purge means 26 connected by a valve 27 to the distribution pipe 12 at its downstream end, that is to say near the sprayer 13. A known type rinsable pressure regulator 29 is connected to the downstream end of the pipe 12, as near as possible to the sprayer 13. A flowrate sensor 30, which will be described in more detail hereinafter, is included in the pipe 12 near its upstream end. A cleaning unit 35 is connected by a valve 36 to the purge means 26 near the valve 27 so that it can clean and dry the pipe portion 28 connecting this valve 27 to the purge means 26. The purge means 22 and 26 are electrically grounded.

The cleaning unit 35 comprises selective connection means adapted to connect either the rinsing product circuit 17 or a compressed air distribution circuit 18 to the valve 36. The pipe 37 connecting the cleaning unit 35 to the valve 36 is made from an electrically insulative material, the cleaning unit 35 being electrically grounded.

At this stage in the description it should be noted that all the pipes connecting the various component parts of the installation are advantageously made from electrically insulative materials. Some of them, for example the pipe 20 mentioned above whose specific function is to provide electrical insulation between two major parts of the installation when one of them is raised to the high-tension voltage, are specifically referred to as "electrically insulative pipes". The length of an electrically insulative pipe of this kind is computed so that it has a sufficiently high electrical resistance, given the high-tension voltage, once it has been cleaned by the rinsing product and dried internally by the compressed air.

A rinsable intermediate storage tank 41 forming part of the distribution pipe 12 is constituted by a section of the distribution pipe 12 of length AB. This is an important feature of the invention. This pipe section is, of course, made from an electrically insulative material and its length is determined according to the volume of paint needed to coat an object entirely. The pipe 12 is also connected through the selective connection means to the color change unit 11 and to rinsing product feed means 40 electrically insulated from ground. In FIG. 1 said selective connection means comprise the valve 21 already mentioned and a valve 45 between the upstream end of the pipe 12 and an outlet pipe 42 of a storage tank 44 containing said rinsing product. This storage tank 44 is electrically insulated from ground. It is substantially sealed and pressurized so that, by virtue of the pressure inside the storage tank, paint may be "propelled" into the pipe 12 during the spraying phase by the rinsing product from the electrically insulated storage tank 44 and flow into the pipe 42 due to the pressure in the storage tank 44. To this end the storage tank 44 is connected to a feed and pressurization unit 46 adapted to deliver rinsing product from a circuit 47 (to top up the level in the storage tank 44) and compressed air from a circuit 48. The compressed air serves both to pressurize the storage tank 44 and to dry the electrically insulative pipe 49 connecting the unit 46 to the storage tank, after a phase in which the latter is topped up. This topping up is done when the storage tank 44 is not at the high-tension voltage; it is then depressurized temporarily to enable the flow of air and drying of the pipe 49. In the embodiment shown the rinsing product storage tank is maintained at a high pressure (in the order of 15 bars) so that the paint can be propelled in spite of the length of the pipe section 41 forming the intermediate storage tank. Given these conditions, regular spraying as the "length" of the paint diminishes is ensured by the pressure regulator 29. All the valves and other units just described are sequenced and the pressure regulator 29 is controlled by a computer (not shown). Many commercially available computers may be used for this purpose. The programming of the computer is within the competence of those skilled in the art. The computer essentially receives information representing the flowrate of the liquid (paint or rinsing product) in the pipe 12. This information is derived from the signal delivered by the flowrate sensor 30.

The FIG. 1 installation operates as follows:

For filling, the high-tension voltage is reduced to zero and the color change unit 11 is operated to select one of the paints. This flows towards the sprayer, the valves 21 and 27 being opened. When there is the necessary quantity to paint an object between the manifold 15 of the color change unit and the pipe 12, the valve in the unit 11 corresponding to the selected paint is closed and at that same time that of the circuit 17 is opened. From this time on the paint is propelled by the rinsing product from the circuit 17. The pipe lengths are computed so that when the paint reaches the sprayer (point B) the "interface" between the rinsing product and the paint is situated at point A, which is downstream of the valve 21 and (preferably) downstream of the flowrate sensor 30.

The valve 27 is closed and the valves 25 and 45 opened. This ensures continuity of the propulsion fluid (that is, the rinsing product) between the pressurized storage tank 44 and the distribution pipe 12. The rinsing product, from the storage tank 44, is briefly directed towards the purge means 22 through the valve 25.

Once this continuity has been established, all the valves are closed and the valve 25 is opened again. The electrically insulative pipe 20 and the pipe 24 are then cleaned and dried using the rinsing product and compressed air from the color change unit. At the same time, the pipes 28 and 37 are cleaned and dried from the cleaning unit 35 and the pipe 49 is cleaned and dried from the unit 46.

The high-tension voltage is then established and the valve 45 is opened to begin painting. The flowrate is monitored at all times and regulated by the flowrate sensor 30 and the pressure regulator 29, via the computer.

The invention therefore makes it possible to clean the distribution pipe 12, the flowrate sensor 30 and the various valves immediately the paint has passed through them, as the paint is propelled by the rinsing product. This timesaving is complemented by that which results from the fact that the shape of the intermediate storage tank 41, that is to say the pipe section of length AB, is such that it is quicker and easier to clean.

The flowrate sensor 30 is at the high-tension voltage during the spraying phase; it must therefore be able to produce a signal that is usable despite the presence of this high-tension voltage. Several solutions are feasible. For preference use is made of a sensor having a mechanical structure similar to that of a gear pump. The liquid passes through the sensor to rotate toothed wheels. The latter can therefore be easily employed to produce a signal at a frequency which varies with the flowrate, by means of an appropriate transducer facing a toothed wheel. This transducer may be of the variable reluctance type, for example. Isolation may be provided by conversion to light pulses and transmission by optical fiber.

Figure 2:
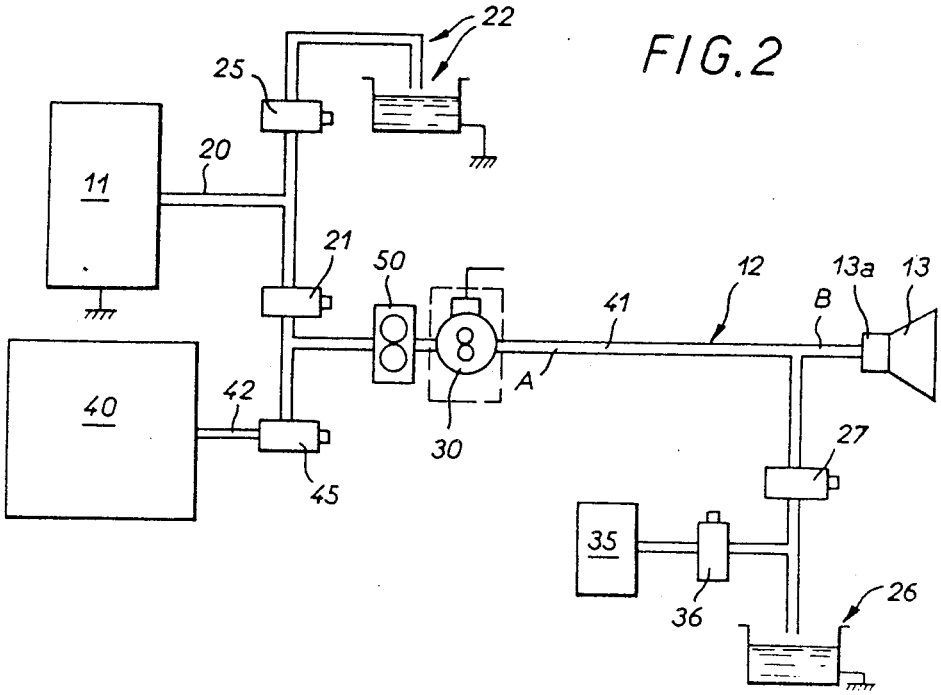
FIG. 2 is a schematic showing a variant of the FIG. 1 embodiment.

The FIG. 2 embodiment is very similar to that of FIG. 1. Analogous component parts carry the same reference numbers and will not be described again. The sequencing is the same. On the other hand, the pressure regulator 29 is eliminated and a rinsable volumetric pump 50 is inserted into the distribution pipe 12, preferably near the flowrate sensor 30, that is to say near the upstream end of the distribution pipe 12. The rinsable pump 50 is preferably a gear pump. Given these conditions, the pressure of the compressed air in the circuit 48 and therefore in the storage tank 44 may therefore be much lower (in the order of a few bars) since it serves only to prime the pump 50. Filling and therefore color changing are nevertheless faster and the product is not subjected to high variations in pressure. Its pressure does not rise until it is about to be sprayed.

Figure 3:
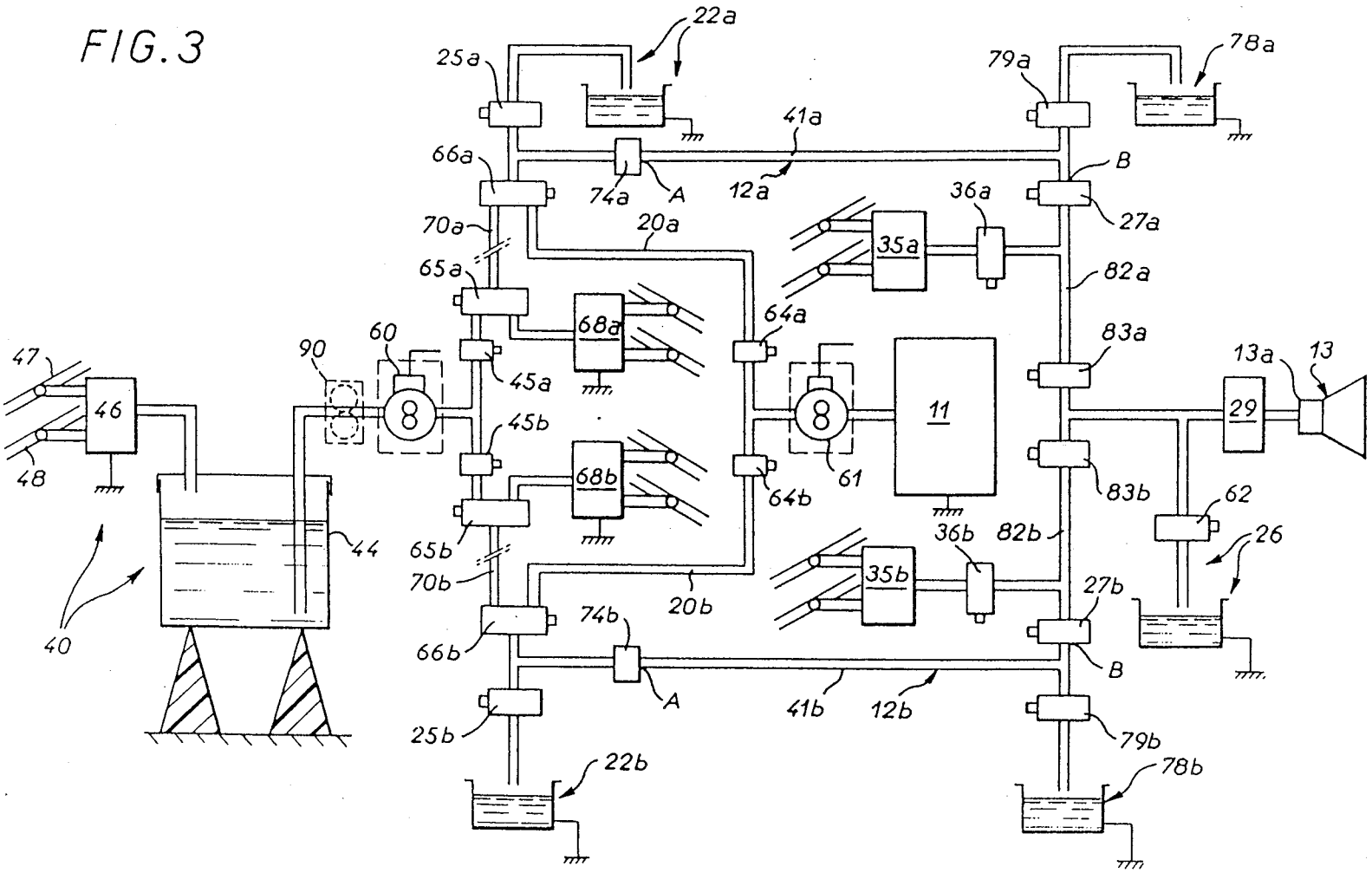
FIG. 3 is a schematic of another embodiment of a paint spraying installation in accordance with the invention with which even shorter color change cycles can be achieved.

The FIG. 3 embodiment makes it possible to reduce further the duration of the color change operations. The distribution pipe as described with reference to FIG. 1 is replaced with two distribution pipes **12*a*, 12*b*** so that one distribution pipe can be cleaned and filled while spraying paint previously transferred into the other distribution pipe.

However, in the FIG. 3 embodiment there is only one color change unit 11 and only one rinsing product feed means 40, electrically insulated from ground. Each distribution pipe **12*a*, 12*b* therefore comprises a section of pipe forming a rinsable intermediate storage tank 41*a*, 41*b* and selective connection means are arranged to connect each of these pipe sections alternately to the color change unit 11 and to the rinsing product feed means 40**, respectively.

In the FIG. 3 diagram components analogous to those of FIG. 1 carry the same reference numbers. Analogous components belonging to or specifically connected to the distribution pipe **12*a* or 12*b*** carry the respective suffix a or b.

The electrically insulated storage tank 44, connected as previously to a feed and pressurization unit 46, therefore communicates with the two pipes **12*a* and 12*b* via (in particular) respective valves 45*a*, 45*b*. A first flowrate sensor 60 is inserted between the outlet from the storage tank 44 and the common inlet to the two valves 45*a*, 45*b*. The color change unit 11 also communicates with the two pipes 12*a* and 12*b* via (in particular) two valves 64*a*, 64*b* and a second flowrate sensor 61 is inserted between the outlet from the unit 11 and the common inlet of the two valves 64*a*, 64*b*. In this embodiment the pressure regulator 29 is immediately adjacent the sprayer 13 (or a group of such sprayers), on its upstream side, and the sprayer is common to the two distribution pipes 12*a*, 12*b*. The purge means 26 are connected immediately adjacent this regulator on its upstream side through a valve 62**.

With regard to the distribution pipe 12*a* between the valve 45*a* and the flowrate sensor 61, on the one hand, and the pressure regulator 29, on the other hand, the following components are found in succession:

The outlet from the flowrate sensor 61 associated with the color change unit is connected by the valve 64*a* to a first electrically insulative pipe 20*a* between the valve 64*a* and one inlet of a three-way valve 66*a* of the type with two inlets and one outlet. Said first electrically insulative pipe 20*a* therefore plays the same role as the pipe 20 described with reference to FIG. 1. A three-way valve 65*a* with two inlets and one outlet has one inlet connected to the outlet of the valve 45*a* and its other inlet connected to a cleaning unit 68*a* simular to the unit 35 of the FIG. 1 installation.

The outlet from the valve 65*a* is connected to the other inlet of the valve 66*a* by a second electrically insulative pipe 70*a*.

The outlet from the valve 66*a* is connected to purge means 22*a* by a valve 25*a* and to the pipe section 41*a* forming the intermediate storage tank of the pipe 12*a* by a valve 74*a*.

The intermediate storage tank 41*a* of length AB therefore extends between the valve 74*a* and a valve 27*a*. The downstream end of the pipe section of length AB is also connected to purge means 78*a* through a valve 79*a*. The outlet from the valve 27*a* is connected to the pressure regulator 29 through a third electrically insulative pipe 82*a* and a valve 83*a* near said regulator. The cleaning unit 35*a* is connected to the outlet from the valve 27*a* by a valve 36*a*. All these circuits and valves are readily rinsable.

It will be understood at this stage in the description that all the connecting means (valves) and the electrically insulative pipes 20*a*, 70*a* and 82*a* are adapted to insulate electrically and selectively the corresponding distribution pipe 12*a* (and consequently the rinsable storage tank 41*a*) from the color change unit, from the cleaning unit and from the other distribution pipe 12*b*, respectively.

It is also apparent that the arrangement is such that each electrically insulative pipe as defined above is connected by valves to the upstream side of cleaning means and to the downstream side of purge means. A distinction can therefore be drawn between the cleaning means for the color change unit 11 and the purge means 22*a* for the electrically insulative pipe 20*a*, the cleaning unit 68*a* and the purge means 22*a* for the electrically insulative pipe 70*a* and the cleaning unit 35*a* and the purge means 26 for the electrically insulative pipe 82*a*. Of course, these cleaning units and purge means are electrically insulated automatically during each cleaning phase by the rinsing and drying operations on the electrically insulative pipes which terminate at them, as explained with reference to the FIG. 1 embodiment. The same goes for the means 46 in relation to the rinsing product storage tank 44.

The distribution pipe 12*b* is strictly identical to the pipe 12*a* and the corresponding components carry the same reference numbers with the index *b* instead of *a*. It therefore comprises the valves 45*b*, 64*b*, 25*b*, 74*b*, 79*b*, 27*b*, 36*b* and 83*b*, the three-way valves 65*b* and 66*b*, the cleaning means 68*b* and 35*b*, the purge means 22*b* and 78*b*, the electrically insulative pipes 20*b*, 70*b* and 82*b* and, of course, the electrically insulative pipe forming the intermediate storage tank 41*b*. All these components are interconnected in the same way as before, so that there is no need to describe the circuit 12*b* further.

As in the FIG. 1 installation, the computer controls all the valves and the pressure regulator 29; it receives signals derived from the output of the two flowrate sensors 60 and 61. It should be noted that the electrically insulative pipes 82*a* and 82*b*, the only function of which is to "withstand" the high-tension voltage once rinsed and dried, are of smaller cross-section that the other pipes. The quantity of product contained in these pipes is therefore low in comparison with that contained in the section 41*a* or 41*b* forming the rinsable storage tank. Also, the pipes 82*a*, 82*b* and the valves and cleaning means associated with them may be eliminated if two independent sprayers 13 and two groups of such sprayers are provided.

Operation is as follows:

Assuming that one of the pipes, for example the pipe 12*b*, has just been filled with paint and that the first electrically insulative pipe 20*b* has been cleaned and dried via the valves 66*b*, 25*b* and the purge means 22*b*, in a similar way to that described with reference to FIG. 1, the pipe 12*b* is therefore ready to paint, the paint being located between the closed valves 74*b* and 27*b*. This situation is arrived at during the spraying phase using the distribution pipe 12*a*, and therefore without any waste of time. The pipe 12*b* is then electrically insulated from the high-tension voltage by the pipes 70*b*, 28 and 82*b* which have been previously cleaned and dried. Before re-establishing the high-tension voltage on the pipe 12*b* and beginning to paint from this pipe, it is necessary to wait for the end of the current spraying phase, using the distribution pipe 12*a*, in order to be able to insulate it electrically. To this end it is sufficient to clean and dry the electrically insulative pipe 70*a* and the electrically insulative pipe 82*a*. From this time continuity of the rinsing product between the storage tank 44 and the distribution pipe 12*b* may be established through the valves 45*b*, 65*b*, 66*b* and 25*b*, as far as the purge means 22*b*. The paint spraying phase may then begin by closing the valve 25*b* and opening the valves 74*b*, 27*b* and 83*b*. During this time paint of another color is fed into the pipe 12*a* and the cycle is completed by cleaning and drying the pipe 20*a*.

Of course, a variant analogous to that of FIG. 2 is quite feasible. It would suffice, for example, to eliminate the pressure regulator 29 and to insert a rinsable volumetric pump 90, preferably a gear pump, between the storage tank 44 and the flowrate sensor 60. In this case, the storage tank 44 no longer needs to be pressurized to a high pressure.

Finally, it should be noted that with an installation of the kind described hereinabove the fact of using a paint and a solvent or rinsing product that is electrically conductive may be advantageous by making it possible to simplify the construction of the electrostatic sprayer 13, that is to say to lighten it, which may be highly beneficial when the sprayer is connected by a multi-axis robot. It then becomes perfectly feasible to apply the high-tension voltage to a component other than the sprayer, in particular the storage tank 44.

Figure 4:
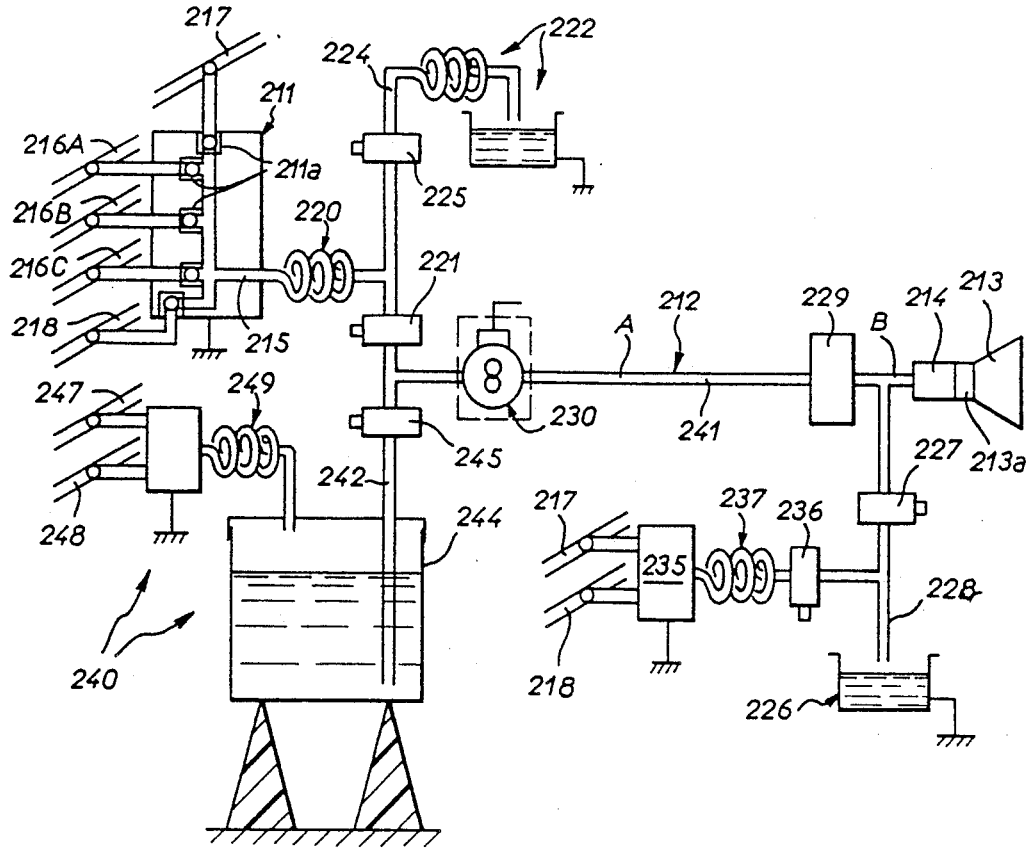
FIG. 4 is a schematic analogous to that of FIG. 1 incorporating improvements directed to enhancing the electrical insulation between the parts at the high-tension voltage and those which are electrically grounded.

The FIG. 4 installation is derived from that of FIG. 1; analogous components carry the same reference numbers increased by 200. The installation will therefore not be described again in complete detail.

Suffice to say that the downstream end of the electrically insulative pipe 220 is connected to the distribution pipe 212 by the valve 221 and to the purge means 222 by a valve 225, through an electrically insulative pipe section 224. The installation also comprises purge means 226 connected by a valve 227 to the distribution pipe 212, at the downstream end of the latter, that is to say near the sprayer 213. A known type rinsable pressure regulator 229 is connected to the downstream end of the pipe 212, that is to say as near as possible to the sprayer 213. A flowrate sensor 230, which will be described in more detail hereinafter, is also inserted into the pipe 212 near its upstream end. A cleaning unit 235 is connected by a valve 236 to the purge means 226, in the vicinity of the valve 227 so that the electrically insulative pipe portion 228 connecting this valve 227 to the purge means 226 can be cleaned and dried. The purge means 222 and 226 are electrically grounded.

The cleaning unit 235 comprises selective connection means adapted to connect either the rinsing product circuit 217 or the compressed air circuit 218 to the valve 236. The pipe 237 connecting the cleaning unit 235 to the valve 236 is an electrically insulative pipe, the cleaning unit 235 being electrically grounded.

The sequencing is such that during at least part of the coating product spraying phase (that is to say when the pipe 212 is connected to the high-tension voltage supply) circulation of air can be maintained in some electrically insulative pipes, notably in this instance the electrically insulative pipe 220 and the electrically insulative pipes 224, 237, 228 and 249. This circulation of air may be established for the pipes 220 and 240 from the feed circuit 218 via the color change unit and the valve 225 left open for this purpose. For the pipes 237 and 228 the circulation of air may be established from the distribution pipe 218 via the unit 35 and the valve 236 left open for this purpose. For the pipe 249 the circulation of air may be established from the distribution pipe 248 via the unit 246, possibly by creating a slight air leak at the storage tank 244.

Also, the rinsable electrically insulative pipes 220, 224, 237 and 249 have at least in part a serpentine configuration, preferably oriented substantially horizontally, for the reasons indicated hereinabove.

The installation operates as follows:

During filling the high-tension voltage supply 213*a* is zeroed and the color change unit 211 is operated to select one of the paints. This flows towards the sprayer, the valves 221 and 227 being open. When the quantity needed to paint an object has been introduced between the manifold 215 of the color change unit and the pipe 212 the valve in the unit 211 corresponding to the selected paint is closed and at the same time that of circuit 217 is opened. From this time the paint is propelled by the rinsing product from the circuit 217. The pipe lengths are computed so that when the paint reaches the sprayer (point B) the "interface" between the rinsing product and the paint is at A, that is to say at a point downstream of the valve 221 and (preferably) downstream of the flowrate sensor 230.

The valve 227 is closed and the valves 225 and 245 opened. This ensures continuity of the propulsion fluid (that is to say the rinsing product) between the pressurized storage tank 244 and the distribution pipe 212. The rinsing product from the storage tank 244 is directed briefly towards the purge means 222 through the valve 225.

When this continuity has been established all the valves are closed and the valve 225 is opened again. The electrically insulative pipe 220 and the pipe 224 are then cleaned and dried using rinsing product and compressed air from the color change unit. At the same time the pipes 228 and 237 are cleaned and then dried from the cleaning unit 235 and the pipe 249 from the unit 246.

The high-tension voltage is then established and painting is begun by opening the valve 245. The flowrate is constantly monitored and regulated by the flowrate sensor 230 and the pressure regulator 229, via the computer. Circulation of air is maintained in the aforementioned electrically insulative pipes.

Of course, the improvements described with reference to FIG. 4 are not limited to the installation specifically described. In particular, the FIG. 2 and 3 installations may be completed as shown in FIG. 4. Specifically, FIG. 3 shows an installation comprising two parallel distribution pipes functioning alternately. This installation therefore comprises a greater number of electrically insulative pipes and in particular electrically insulative pipes as defined herein between the color change unit and each of the distribution pipes, between the distribution pipes themselves and also between each distribution pipe and the sprayers.

It is clear that all these pipes may be "blown" when the high-tension voltage is present and/or given a serpentine configuration.

FIGS. 5 through 9 show another development of the invention and structural components analogous to those of FIGS. 1 through 3 carry the same reference numbers.

Figure 5:
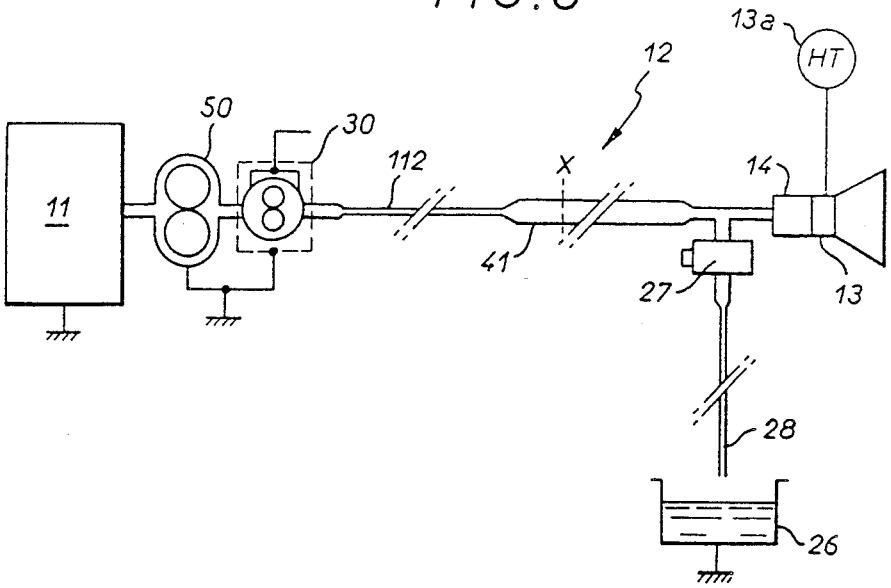
FIG. 5 is a schematic showing another installation in accordance with the invention incorporating a pump for propelling the coating product.

In the selected embodiment shown in FIG. 5 an electrically grounded gear pump 50 of the rinsable type is connected to the outlet from a coating product change unit 11, which is generally electrically grounded. This pump discharges into a distribution pipe 12 through a flowrate sensor 30 of a type derived from a gear pump. An electrostatic type sprayer 13 is connected to the end of the distribution pipe 12, with a needle valve 14 to control the admission of paint to the sprayer. This sprayer 13, of the rotating head or pneumatic or hydrostatic sprayer type, is a single or multiple sprayer depending on the application. It is connected to a selectively connectable high-tension voltage supply 13*a*.

A purge circuit branches from the distribution pipe 12 immediately upstream of the sprayer 13. It comprises a valve 27 in the immediate vicinity of the pipe 12, an electrically insulative pipe 28 and an electrically grounded purge manifold 26.

As previously, the term electrically insulative pipe is used here to mean pipes of an electrically insulative material the length of which is sufficient to withstand the high-tension voltage after having been rinsed and dried internally using compressed air.

The distribution pipe 12 comprises a section 41 forming an intermediate storage tank the length and flow cross-section of which are determined to define a volume at least equal to that of the quantity of paint needed for an object (in the order of 0.3 liter for an automobile body). To give an example, use may be made of pipes with an internal diameter in the order of 4 to 6 mm, in which case the length of the intermediate storage tank section is 10 to 25 meters.

Between the flowrate sensor 30 and the intermediate storage tank 41 is a guard channel 112 the diameter of which is less than that of the intermediate storage tank. A rinsing product of high electrical resistivity ($>10^6$ ohm.m) is chosen. The cross-section of the guard channel and its length are determined so that the electrical resistance of the column of liquid filling it are sufficient for the electrical current shunted into the column of liquid in response to application of the high-tension voltage to be negligible as compared with the consumption of the sprayer. For example, a guard channel 1 m long with an inside diameter of 2 mm when filled with a rinsing liquid with a resistivity of $10^6$ ohm.m has a resistance of $3.2\times10^{11}$ ohms. With a high-tension voltage of 50 kV the current flowing through it will be in the order of 0.16 $\mu$A.

The FIG. 5 device operates as follows:

At the end of spraying a paint of a particular color the high-tension voltage supply 13A is cut off and the needle valve 14 of the sprayer is closed. At this time all of the distribution pipe 12 is filled with rinsing product, as will be explained later. The purge valve 27 opens while the valve of the color change unit 11 controlling admission of rinsing product is closed and the compressed air inlet valve is opened. The compressed air drives out the rinsing product through the pump 50, the flowrate sensor 30, the guard channel 112, the intermediate storage tank 41, the open valve 27 and the electrically insulative pipe 28, into the purge manifold 26. Further compressed air evaporates any residue of rinsing product and dries all parts of the circuit.

At this time the valve in the coating product change unit 11 corresponding to the coating product for the next arriving object to be painted is open. The pump 50 feeds the coating product to the distribution pipe through the flowrate sensor 30. When the latter has measured the volume of coating product needed for spraying (if necessary taking account of the volume still upstream of the sensor 30 in the pump 50 and its connection to the unit 11), this unit is operated to cut off the feed of the coating product and to substitute for it the rinsing product which, due to the action of the pump 50, propells the coating product towards the downstream end of the distribution pipe 12. When the flowrate sensor 30 has registered a volume of product such that the leading edge of the coating product is at the level of the purge branch connection, the valve 27 is closed. At this time the coating product is entirely contained in the intermediate storage tank 41, while the rinsing product fills the pump 50, the flowrate sensor 30 and the guard channel 112. Between the coating product and the rinsing product is an interface X situated in the intermediate storage tank near its upstream end, this interface consisting of a mixture of coating product and rinsing product. This interface, the limits of which are not clearly defined, of course, occupies a small length of the intermediate storage tank.

When the valve 27 is closed, the needle valve 14 of the sprayer 13 is opened and spraying begins with the connection of the high-tension voltage supply 13*a*. Although the coating product is electrically conductive, the guard channel 112 filled with electrically insulative rinsing liquid and the dry electrically insulative pipe 28 provide electrical insulation relative to ground while the intermediate storage tank, over the length occupied by the coating product, is substantially at the voltage from the high-tension voltage supply 13*a*.

During spraying of the coating product the pump 50 feeds rinsing product into the distribution pipe and the interface X moves from the upstream to the downstream end of the intermediate storage tank, so rinsing the intermediate storage tank. The electrical insulation provided by the guard channel 112 is reinforced by the formation of a column of rinsing product in the intermediate storage tank 41, upstream of the interface X.

At the end of the cycle the automatic control system terminates spraying.

At this time the interface X has reached the purge branch connection. The high-tension voltage supply 13*a* is disconnected, the needle valve 14 is closed and the valve 27 is opened. The installation has returned to the initial state as described hereinabove.

Figure 6:
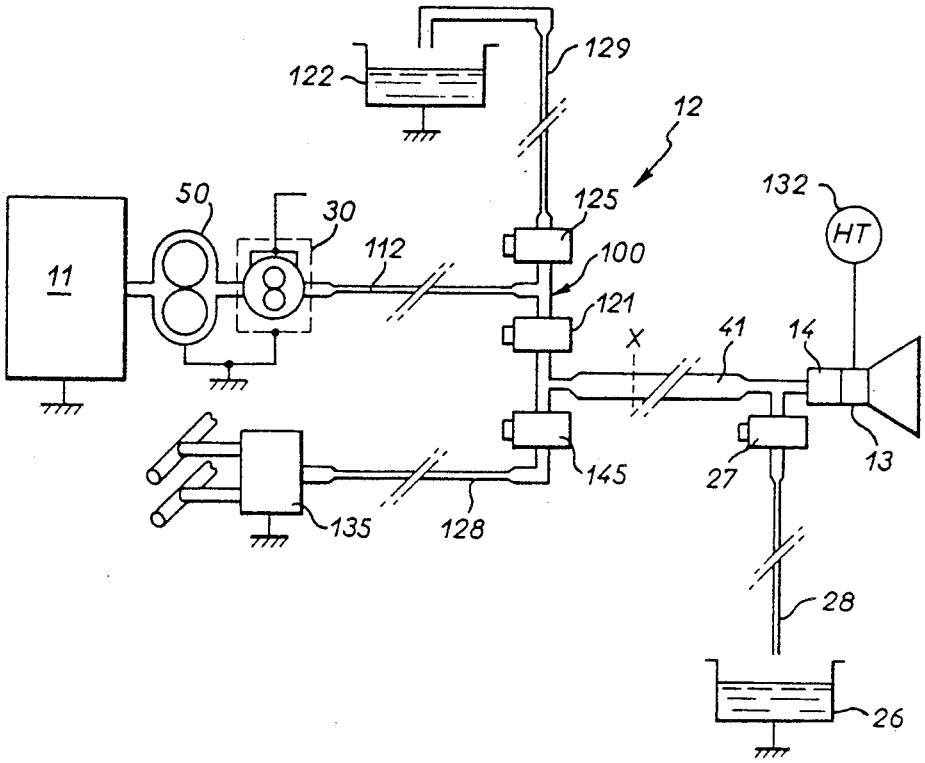
FIG. 6 is a variant of FIG. 5 showing a connection circuit between a guard channel and an intermediate storage tank.

The installation shown in FIG. 6 differs from that of FIG. 5 in that a selective connection circuit electrically insulated from ground is provided between the guard channel 112 and the intermediate storage tank 41. It comprises a pipe 100 to which are connected the guard channel 112 and the intermediate storage tank 41 and three valves on the pipe 100, namely a valve 121 between the connections to the guard channel 112 and the intermediate storage tank 41, a valve 125 between the connection to the guard channel 112 and a first end of the pipe extended by an electrically insulative pipe 129 discharging into a purge manifold 122, and a valve 145 between the connection to the intermediate storage tank 41 and the second end of the pipe 100, connected to a rinsing circuit or cleaning unit 135 through an electrically insulative pipe 128. The complementary set of valves 121 and 145 switches the inlet of the intermediate storage tank between the guard channel 112 and the cleaning unit 135 while opening the valve 125 branches the guard channel 112 to the purge manifold 122.

With this arrangement according to FIG. 2, when all of the coating product has been fed into the intermediate storage tank 41 the valve 121 may be closed and the valve 125 opened to rinse the pump 50, the flowrate sensor 30 and the guard channel, with the rinsate purged to the manifold 122, to dry the circuit using compressed air, and then to re-establish communication between the guard channel 112 and the intermediate storage tank 41 so that electrically insulative rinsing product reaches the intermediate storage tank 41 to feed the sprayer 13. At the end of spraying the valve 121 and the valve 145 are opened to clean the intermediate storage tank 41 from the cleaning unit 135. It will be noted that the cleaning unit 135 can be fed with a rinsing product different to the electrically insulative rinsing product used in the coating product change unit 11.

This arrangement reduces the risk of there remaining on the inside wall of the guard channel 112 any traces of water-soluble or metallic paint which the rinsing product might not have removed completely at the very start of its injection. Also, the rinsing product delivered by the cleaning unit 135 may be chosen to be more effective or less costly than the electrically insulative rinsing product used to propell the coating product, as the rinsing product delivered by the cleaning unit 135 is not required to be electrically insulative.

Figure 7:
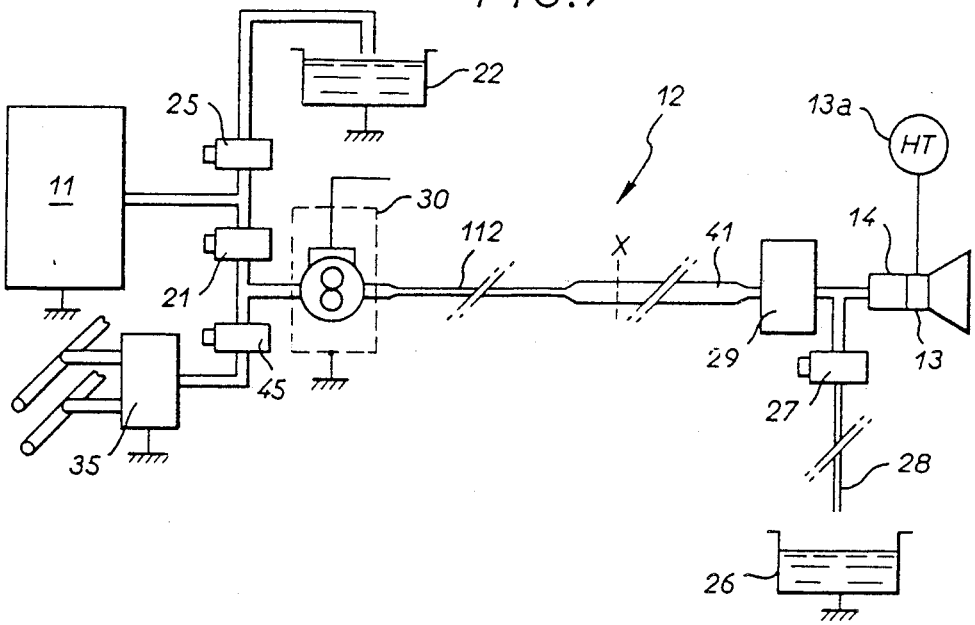
FIGS. 7 and 8 respectively correspond to FIGS. 5 and 6 with propulsion by pressurization substituted for the propulsion by a pump.
Figure 8:
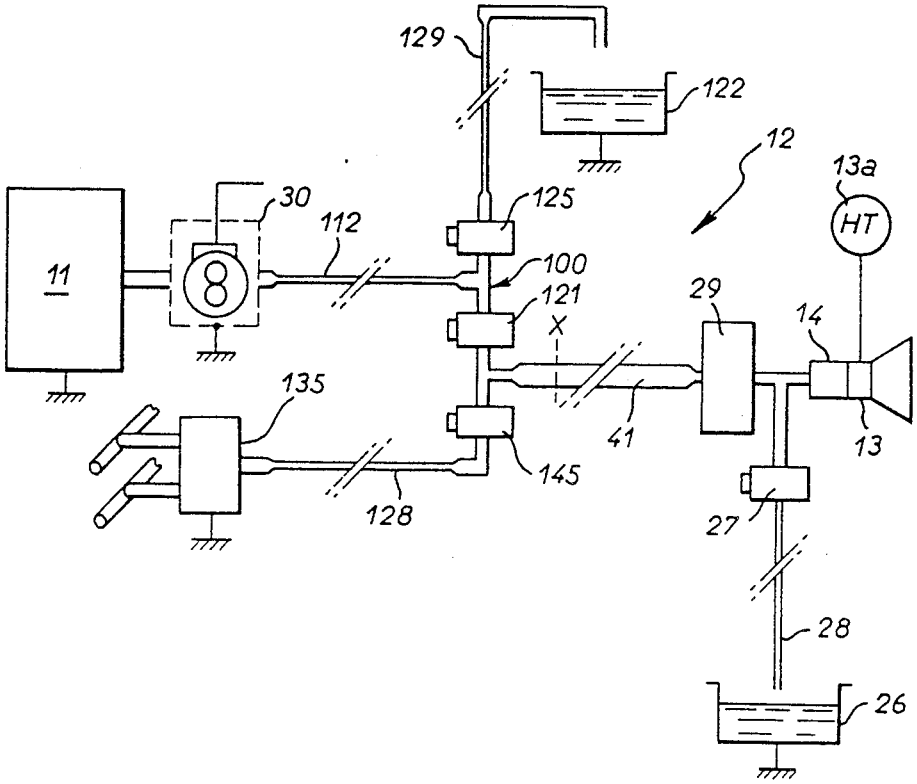

The arrangements shown in FIGS. 7 and 8 repeat for the most part the arrangements of FIGS. 5 and 6, respectively. However, there is no pump 50 and the electrically insulative rinsing product delivered by the coating product change unit 11 of FIG. 8 and by the cleaning unit 35 of FIG. 7 is delivered at a high pressure, in the order of 15 bars. At the end of the intermediate storage tank 41 is a known rinsable pressure regulator 29 which enables the pressure of the coating product to be adapted to suit the particular circumstances.

It will be noted that according to FIG. 7 the flowrate sensor 30 is fed by a selective connection circuit comprising three valves 21, 25 and 45 connected to a coating product change unit 11 and to a cleaning unit 35. The rinsing product delivered by the cleaning unit 35 is electrically insulative and propels the coating product in the distribution pipe. It is therefore possible to rinse the coating product change unit 11 while the cleaning unit 35 serves to propel the coating product during the spraying phase.

Figure 9:
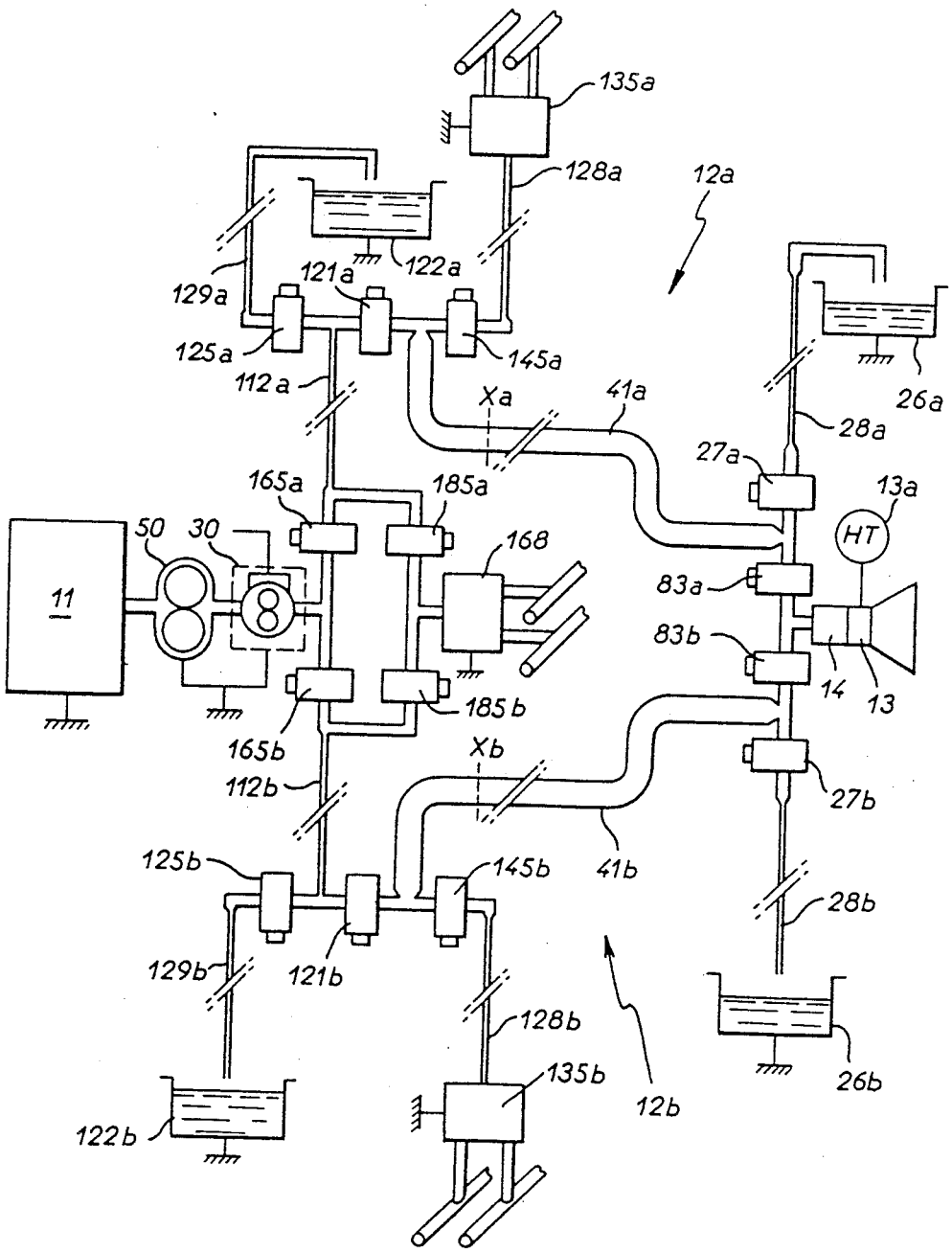
FIG. 9 shows a development of the FIG. 6 installation, with duplicated distribution pipes.

The installation shown in FIG. 9 comprises two parallel distribution pipes 12*a* and 12*b* similar to the distribution pipe 12 of FIG. 6 between a coating product change unit 11 followed by a pump 50 and a flowrate sensor 30 and a sprayer 13 (or a group of sprayers) with its high-tension voltage supply 13*a*. The two distribution pipes 12*a* and 12*b* function alternately, one pipe being in the spraying phase while the other is in the cleaning phase.

To this end two complementary function valves 165*a* and 165*b* are provided between the outlet from the flowrate sensor 30 and the inlet of each of two guard channels 112*a* and 112*b*, together with two valves 83*a* and 83*b* functioning synchronously with the valves 165*a* and 165*b* between the ends of each of the intermediate storage tanks 41*a* and 41*b* and the needle valve 14 of the sprayer 13. Two valves 185*a* and 185*b* connect a cleaning unit 168 to the respective inlets of the guard channels 112*a* and 112*b*. The valves 185*a* and 185*b* are operated at the same time as the valves 165*b* and 165*a* so that when the distribution pipe 12*a* or 12*b* is fed from the coating product change unit 11 the other pipe 12*b* or 12*a* is connected to the cleaning circuit 168.

However, the cleaning circuit 168 is provided essentially for cleaning and drying the guard channels 112*a* and 112*b* while the intermediate storage tanks 41*a* and 41*b* are cleaned and dried from respective cleaning units 135*a* and 135*b*.

It will be noted that correct functioning of the FIG. 9 installation requires the use of electrically insulative rinsing products at all points, since the component parts of the distribution pipes 12*a* and 12*b* are rinsed with the sprayer 13 connected to the high-tension voltage supply.

It will be appreciated that the sequencing of operations and in particular the operation of the various valves is controlled by a microprocessor the programming of which, which is outside the scope of the present invention, confers great flexibility on the process. It will be possible to command certain operations on the distribution pipe 12*a* or 12*b* being cleaned synchronously with operational stages on the distribution pipe 12*b* or 12*a* in the spraying phase, to minimize interference. For example, preliminary rinsing could be performed on the pipe in the cleaning phase during filling of the intermediate storage tank of the pipe in the spraying phase, this filling being executed with the high-tension voltage supply 13*a* disconnected.

What is claimed is:

1. An installation for electrostatically spraying conductive coating products comprising:

(a) a grounded coating product change unit;
(b) at least one distribution pipe on a downstream side of said coating product change unit;
(c) at least one electrostatic sprayer for said coating product fed by said at least one distribution pipe;
(d) an intermediate coating product storage tank constituted by a section of said distribution pipe;
(e) insulated rinsing product feed means;
(f) electrically isolating means by which said coating product change unit is connected to said intermediate coating product storage tank; and
(g) selective connection means such as to propel coating product by rinsing product from said insulated rinsing product feed means during electrostatic spraying of said coating product.

2. An installation for electrostatically spraying conductive coating products comprising:

(a) a grounded coating product change unit;
(b) at least one distribution pipe on a downstream side of said coating product change unit;
(c) at least one electrostatic sprayer for said coating product fed by said at least one distribution pipe;
(d) an intermediate coating product storage tank constituted by a section of said distribution pipe;
(e) a rinsing product storage tank electrically insulated from ground;
(f) electrically isolating means by which said coating product change unit is connected to said intermediate coating product storage tank; and
(g) selective connection means such as to propel coating product by rinsing product from said insulated rinsing product storage tank during electrostatic spraying of said coating product.

3. Installation according to claim 2, further comprising a flowrate sensor in said at least one distribution pipe on the upstream side of said intermediate storage tank.

4. Installation according to claim 2, including a distribution pipe adapted to be connected to a high-tension voltage supply and at least one electrically insulative pipe connected to said distribution pipe, wherein at least part of said electrically insulative pipe has a serpentine configuration.

5. Installation according to claim 4, wherein said serpentine configuration is substantially horizontal.

6. Installation according to claim 2, including a distribution pipe adapted to be connected to a high-tension voltage supply, at least one electrically insulative pipe connected to said distribution pipe and means for blowing air into said at least one electrically insulative pipe during at least part of the time for which said distribution pipe is connected to said high-tension voltage supply.

7. Installation according to claim 6, wherein at least part of said at least one electrically insulative pipe has a serpentine configuration.

8. Installation according to claim 7, wherein said serpentine configuration is substantially horizontal.

9. Installation according to claim 6, wherein said at least one electrically insulative pipe is or includes an electrically insulative pipe which is part of said distribution pipe adapted to be connected to a high-tension voltage supply.

10. Installation according to claim 6, further comprising a rinsing product storage tank electrically insulated from ground and means for filling said tank and wherein said at least one electrically insulative pipe is or includes a pipe between said tank and said filling means.

11. Installation according to claim 6, further comprising purge means and a cleaning system and wherein said at least one electrically insulative pipe is or includes a pipe in said cleaning system.

12. Installation according to claim 2, wherein said selective connection means comprise valve means interconnected between, downstream, said section of said distribution pipe and, upstream, said coating product change unit and said insulated rinsing product feed means; and said at least one electrostatic sprayer to which is connected said distribution pipe being capable of being sequentially supplied by high tension voltage.

13. Installation according to claim 12, wherein said isolating means comprise a rinsable first electrically insulative pipe; and said coating product change unit includes a rinsing product circuit and a compressed air circuit.

14. Installation according to claim 12, wherein said rinsing product storage tank is sealed and adapted to be pressurized by a compressed air supply.

15. Installation according to claim 14, further comprising a rinsable pressure regulator in said at least one distribution pipe near said at least one electrostatic sprayer and wherein said rinsing product storage tank is adapted to be maintained at a high pressure.

16. Installation according to claim 14, further comprising a pump, optionally a gear pump, in said at least one distribution pipe on an upstream side of said intermediate storage tank and wherein said rinsing product storage tank is adapted to be maintained at a low pressure.

17. Installation according to claim 12, comprising two distribution pipes, a respective intermediate storage tank in each distribution pipe constituted by a section of said pipe, and connections means for connecting each intermediate storage tank alternately to said coating product change unit and said rinsing product feed means.

18. Installation according claim 17, further comprising a first flowrate sensor between said rinsing product feed means and said distribution pipes and a second flowrate sensor between said coating product change unit and said distribution pipes.

19. Installation according to claim 17, further comprising a rinsable pressure regulator near said at least one sprayer and an electrically insulated sealed storage tank for rinsing product in said rinsing product feed means adapted to be maintained at a high pressure.

20. Installation according to claim 17, wherein said rinsing product feed means include an electrically insulated storage tank for rinsing product adapted to be maintained at a low pressure and further comprising a pump, optionally a gear pump, between said electrically insulated storage tank and said two distribution pipes.

21. Installation according to claim 17, wherein each distribution pipe includes a three-way or like valve having two inlets and one outlet, one inlet of said valve is connected to said rinsing product feed means, the other inlet of said valve is connected to said coating product change unit and said outlet of said valve is connected to said intermediate storage tank, which is rinsable.

22. Installation according to claim 21, wherein each distribution pipe includes electrical insulation means comprising said first electrically insulative pipe, which is between one inlet of said valve and said coating product change unit, and a second electrically insulative pipe between the other inlet of said valve and said rinsing product feed means, which are electrically insulated from ground.

23. Installation according to claim 22, further comprising means for feeding said at least one sprayer alternately from said two distribution pipes and wherein said electrical insulation means of each distribution pipe include a rinsable third electrically insulative pipe on a downstream side of said intermediate storage tank.

24. An installation for electrostatically spraying conductive coating product comprising:

(a) a grounded coating product change unit;
(b) at least one distribution pipe on a downstream side of said coating product change unit;
(c) at least one electrostatic sprayer for said coating product fed by said at least one distribution pipe, said sprayer being adapted to be connected to high-tension voltage source during spraying;
(d) an intermediate coating product storage tank constituted by a section of said distribution pipe;
(e) feed means for high electrical resistivity rinsing product;
(f) selective connection means for propelling coating product by rinsing product from said feed means during electrostatic spraying of said coating product;
(g) an electrically grounded flow rate sensor on an upstream side of said at least one distribution pipe; and
(h) a guard channel between said sensor and said intermediate storage coating product tank, the length and cross-section of which are such that when filled with said rinsing product, it diverts to said grounded flow rate sensor a minimal part of an electrical current flowing to said at least one electrostatic sprayer.

25. Installation according to claim 24, further comprising a pump, optionally a gear pump, immediately adjacent said flowrate sensor on its upstream side.

26. Installation according to claim 24, further comprising a rinsable pressure regulator between said intermediate storage tank and said at least one sprayer and wherein said rinsing product feed means are adapted to feed said rinsing product at a high pressure.

27. Installation according to claim 24, further comprising a purge circuit branching from said at least one distribution pipe immediately adjacent said at least one sprayer on its upstream side and including a valve near said at least one distribution pipe, an electrically grounded purge manifold and an electrically insulative pipe discharging into said manifold.

28. Installation according to claim 24, comprising two distribution pipes, two intermediate storage tanks, one in each distribution pipe, two guard channels, one in each distribution pipe, a coating product change unit, an electrically grounded flowrate sensor, an electrically grounded rinsing circuit and connection means such as to connect said distribution pipes alternately to said change unit via said sensor and to said rinsing circuit.

29. Installation according to claim 24, further comprising an electrically insulated connection circuit between said guard channel and said intermediate storage tank, a rinsing circuit, a purge manifold and electrically insulative pipes between said connection circuit and said rinsing circuit and said purge manifold, said connection circuit being adapted to connect said intermediate storage tank selectively to said guard channel and said rinsing circuit.

30. Installation according to claim 29, wherein said connection circuit includes a channel between said electrically insulative pipes and to which said guard channel and said intermediate storage tank are connected, and three valves on said channel, one between said guard channel and said intermediate storage tank, one between said guard channel and said purge manifold and one between said intermediate storage tank and said rinsing circuit.

* * * * *